United States Patent [19]

Waters

[11] Patent Number: 4,821,682

[45] **Date of Patent: * Apr. 18, 1989**

[54] METHOD AND APPARATUS FOR UTILIZING WASTE HEAT IN HOT WATER HEATERS

[76] Inventor: Larry G. Waters, 1943 Oakley, Topeka, Kans. 66604

[ * ] Notice: The portion of the term of this patent subsequent to Oct. 13, 2004 has been disclaimed.

[21] Appl. No.: 77,635

[22] Filed: Jul. 24, 1987

Related U.S. Application Data

[62] Division of Ser. No. 860,877, May 8, 1986, Pat. No. 4,699,091.

[51] Int. Cl.[4] ..... F22B 30/00

[52] U.S. Cl. ..... 122/20 A; 122/16; 122/20 B; 122/169; 126/362; 237/19

[58] Field of Search ..... 122/20 A, 20 B, 13 R, 122/14, 17, 155 R, 166 R, 166 A, 169, 244, 245, 247, 249, 250 R, 250 S; 237/8 R, 19; 126/361, 362, 364, 365; 236/20 R

[56] References Cited

U.S. PATENT DOCUMENTS

| | | | |
|---|---|---|---|
| 2,814,279 | 11/1957 | Thomas | 236/20 |
| 3,007,470 | 11/1961 | Heeger | 237/8 |
| 4,106,692 | 8/1978 | Baier | 237/8 R |
| 4,178,907 | 12/1979 | Sweat, Jr. | 126/101 |
| 4,344,568 | 8/1982 | Stewart et al. | 237/8 R |
| 4,371,111 | 2/1983 | Pernosky | 237/8 R |
| 4,699,091 | 10/1987 | Waters | 122/20 A |

*Primary Examiner*—Steven E. Warner

*Attorney, Agent, or Firm*—Kokjer, Kircher, Bradley, Wharton, Bowman & Johnson

[57] ABSTRACT

Normally wasted heat from the pilot burner and flue of a fuel fired hot water heater is used to preheat the water supplied to the main tank. An auxilliary storage tank receives incoming cold water. Water from the storage tank circulates through a conduit loop which extends in a spiral pattern through the flue and also through a special heat exchanger which concentrates heat generated by the pilot burner. The water that is preheated in the conduit loop is returned to the storage tank for storage until required by the main tank, at which time the preheated water is delivered to the main tank through a transfer conduit. Alternative embodiments are arranged to effect automatic flushing of the conduit loop when hot water is withdrawn from the main tank.

6 Claims, 2 Drawing Sheets

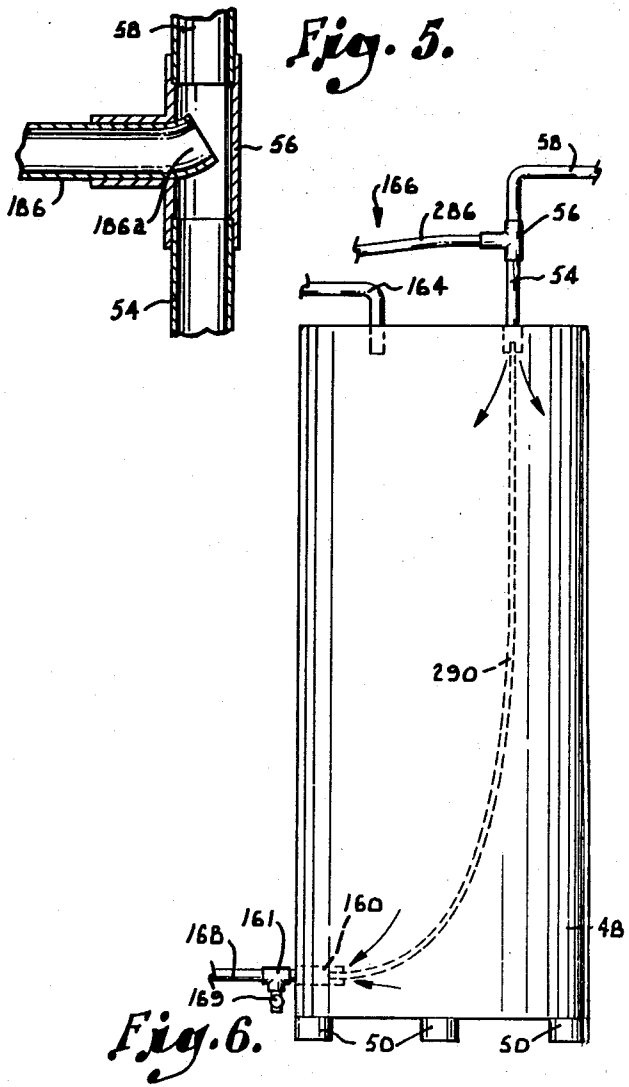
Fig. 5.
Fig. 6.
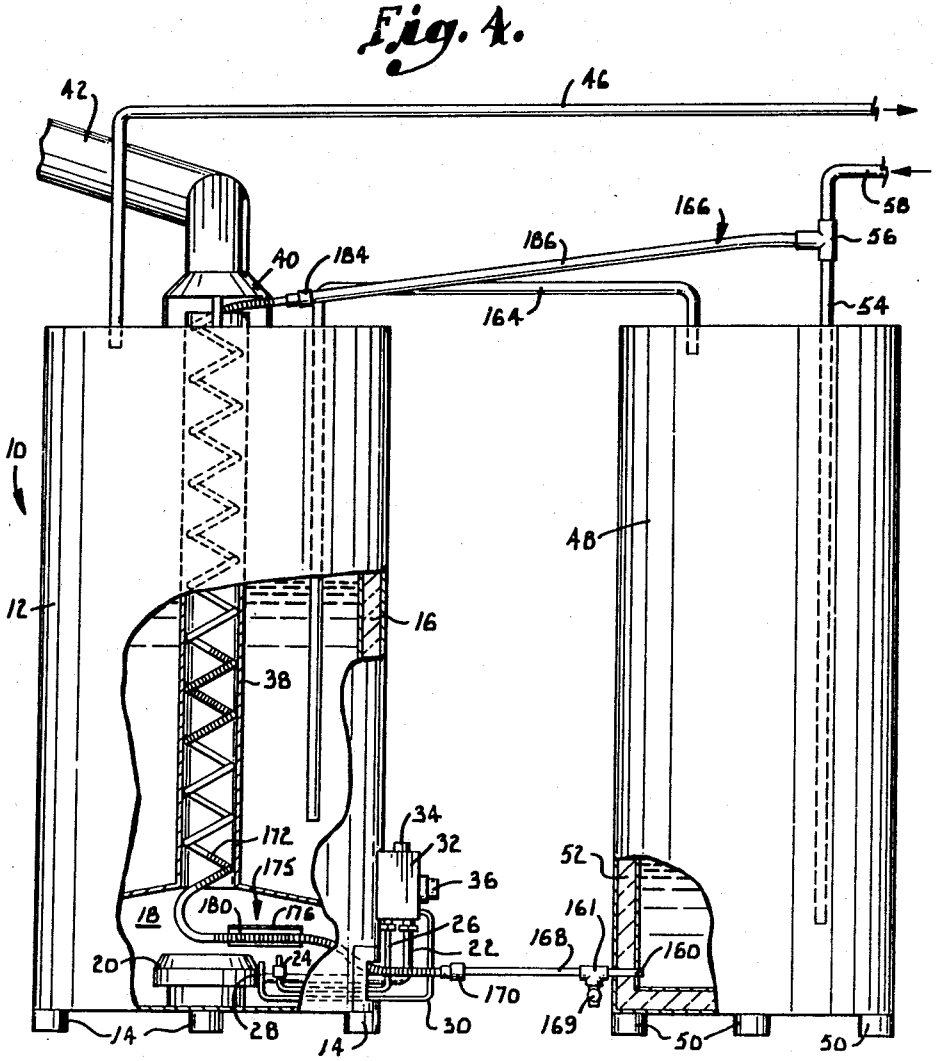
Fig. 4.

METHOD AND APPARATUS FOR UTILIZING WASTE HEAT IN HOT WATER HEATERS

This is a division of application Ser. No. 860,877, filed May 8, 1986, now U.S. Pat. No. 4,699,091.

BACKGROUND AND SUMMARY OF THE INVENTION

This invention relates generally to the heating of water and more particularly to a method and apparatus for using waste heat to enhance the efficiency of fuel fired hot water heaters.

Domestic hot water heaters which use natural gas, fuel oil, or propane as a fuel typically have a pilot burner which burns continuously so that it can ignite the main burner when heating of the water is required. The heat from the pilot light is in large part lost through the furnace flue and is thus essentially wasted energy which does not contribute significantly to heating of the water. The temperature of the flue in the water heater is normally in the range of about 100° F. to 150° F. when only the pilot light is burning. When the main burner is ignited, the flue temperature is raised to about 450° F.–400° F. Although various measures have been taken to more efficiently use the heat of the flue gases, such as providing spiral baffles in the flue, a large amount of heat is still lost through the flue, and the efficiency of the water heater suffers accordingly.

It is the principal goal of the present invention to increase the efficiency of fuel fired hot water heaters by making use of what is normally waste heat.

More specifically, it is an object of the invention to provide a method and apparatus for using heat from the pilot burner to preheat water which is supplied to the water heater tank, thereby decreasing the heating requirements of the main burner to reduce the fuel use.

Another important object of the invention is to provide a method and apparatus for extracting heat from the flue gases and using the heat for preheating of the water before it is delivered to the main water heater tank.

A further object of the invention is to provide a preheating system which can be supplied either as original equipment along with a hot water heater or as add-on equipment that can be quickly and easily connected with an existing hot water heater.

An additional object of the invention is to provide a preheating system in which flushing of the conduits, either in the direction of normal flow or in the reverse direction, occurs automatically when hot water is removed from the main tank.

In accordance with the invention, an auxilliary water storage tank is provided side by side with a conventional fuel fired water heater. The incoming cold water that is to be heated is initially delivered to the storage tank. In one embodiment of the invention, a small pump operates continuously to pump the water from the storage tank through a conduit loop which extends through the flue of the main tank and through a special heat exchanger located adjacent to the pilot burner. In another embodiment, circulation occurs naturally due to thermal effects. In either arrangement, the water which is heated in the conduit loop is returned to the storage tank and stored until required by the main tank. Then, a transfer conduit transfers the preheated water from the storage tank to the main tank, and the preheating of the water reduces the heating requirements of the main burner.

The sections of the conduit loop that extend through the flue and heat exchanger are preferably corrugated pipe in order to enhance the heat transfer to the water that is circulated by the pump. The sections of the conduit in the flue are arranged in a spiral configuration to increase the residence time of the hot combustion gases in the flue and also to provide a large surface area for transfer of heat to the conduit. The heat exchanger can take the form of an open bottom hood located immediately above the pilot burner to concentrate the heat that is generated by the pilot flame. Preferably, the conduit loop is arranged such that it is automatically flushed to prevent the accumulation of debris.

DESCRIPTION OF THE DRAWINGS

In the accompanying drawings which form a part of the specification and are to be read in conjunction therewith and in which like reference numerals are used to indicate like parts in the various views;

FIG. 4 is a side elevational view showing a gas fired hot water heater which is equipped with a preheating arrangement constructed according to another embodiment of the invention, with portions broken away for purposes of illustration;

FIG. 5 is a fragmentary sectional view on an enlarged scale of the special T connection included in the embodiment of FIG. 4; and FIG. 6 is a fragmentary side elevational view of the storage tank and related piping of still another embodiment of the invention, with the direction of arrows illustrating the water flow pattern when incoming cold water is delivered to the storage tank.

DETAILED DESCRIPTION OF THE INVENTION

Figures 1, 2, 3:
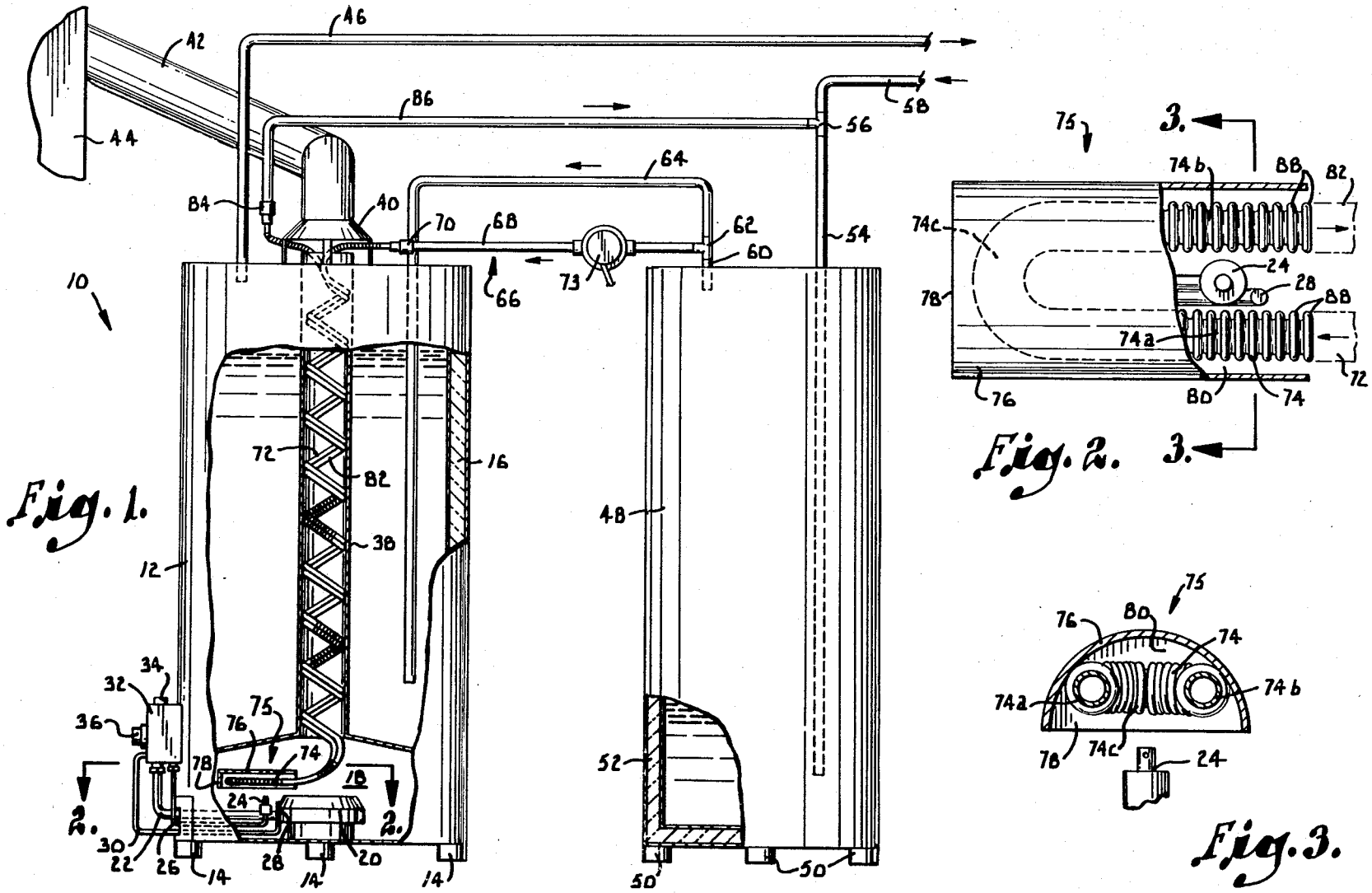
FIG. 1 is a side elevational view showing a gas fired hot water heater which is equipped with a preheating arrangement constructed according to one embodiment of the present invention, with portions broken away for purposes of illustration.
FIG. 2 is a fragmentary sectional view of an enlarged scale taken generally along line 2—2 of FIG. 1 in the direction of the arrows, with a portion broken away for purposes of illustration.
FIG. 3 is a fragmentary sectional view taken generally along line 3—3 of FIG. 2 in the direction of the arrows.

Referring now to the drawing in more detail and initially to FIG. 1, numeral 10 generally designates a hot water heater that uses natural gas as a fuel. It is to be understood that the present invention is equally useful in connection with other fuel fired hot water heaters, such as those that use propane or fuel oil.

The hot water heater 10 is constructed in a conventional manner for the most part and includes a cylindrical main tank 12 supported on feet 14 and lined with insulation 16. A combustion chamber 18 located in the bottom portion of tank 12 contains a main burner 20 which is supplied with gas by a burner supply line 22. The combustion chamber 18 also contains a pilot burner 24 which is located to the side of the main burner 20 and which serves in the usual manner to ignite the main burner when water is heated in the tank 12. A pilot line 26 supplies gas to the pilot burner 24. A thermocouple 28 is located adjacent the main burner and has an electrical lead 30 extending from a control box 32 located on one side of the tank. The control box 32 is equipped with a gas control knob 34 and with a temperature control knob 36 which control the gas flow.

The combustion gases that result from the burning of fuel in the combustion chamber 18 are directed out of the water heater through a flue 38 that extends upwardly from the combustion chamber generally along the vertical axis of tank 12. A flue hat 40 is mounted on top of tank 12 above the upper end of flue 38 and connects with a flue pipe 42 which directs the flue gases into a main flue 44 which may also receive combustion gases from a furnace or other appliance. A hot water outlet pipe 46 extends from the interior of tank 12 and connects with a pipe network which distributes the hot water to water taps and other appliances served by the hot water system.

In accordance with the present invention, a storage tank 48 is provided to one side of the main tank 12 for storage of preheated water. The storage tank 12 has feet 50 and an insulated lining 52. Incoming cold water from the primary water supply is delivered to the storage tank 12 through an inlet pipe 54. The inlet pipe 54 connects through a T fitting 56 with a pipe 58 that receives water from the primary water source. The preheated water in tank 48 is transferred to the main tank 12 through an outlet pipe 60 which connects through a T fitting 62 with a transfer conduit 64. The transfer conduit extends into the main tank 12.

Water is preheated in a conduit loop which is generally designated by numeral 66 and which includes a generally horizontal conduit 68 which connects with the horizontal leg of fitting 62. Conduit 68 connects through a coupling 70 with a corrugated pipe 72. An electric pump 73 pumps water through the conduit loop 66. Pump 73 is disposed in conduit 68 and is preferably a 20 watt pump having a capacity of approximately 200 gallons per hour. If tank 48 is a 50 gallon tank, pump 73 is capable of pumping the tank capacity through the conduit loop four times per hour.

Corrugated pipe 72 passes into the top end of flue 38 and extends downwardly through the flue in a spiral pattern. Pipe 72 exits from flue 38 into the combustion chamber 18 and connects at its lower end with a U shaped corrugated pipe, 74 which forms part of a special heat exchanger generally designated by numeral 75.

As best shown in FIGS. 2 and 3, the heat exchanger 75 includes a hood 76 which is generally semi-circular in section and open at the bottom. One end 78 of the hood 76 is closed, while the opposite end is open to receive the two legs 74a and 74b of the U shaped pipe 74. Hood 76 is suitably secured to the U shaped pipe 74, as by brazing, soldering or by another suitable means. The hood 76 is located immediately above the pilot burner 24 and provides a heat exchange chamber 80 which is located immediately above the pilot burner and is oriented to receive and confine the heat that is generated by the pilot flame. The U shaped pipe 74 is located in the heat exchange chamber 80 and is exposed to the pilot burner heat which is concentrated in the chamber.

As best shown in FIG. 2, pipe 72 connects to one leg 74a of the U shaped pipe 74, and another corrugated pipe 82 connects with its other leg 74b. The legs 74a and 74b are connected by a curved bight 74c located near end wall 78 of hood 76. Pipe 82 extends upwardly through flue 38 adjacent to pipe 72 and in the same spiral pattern (see FIG. 1). The upper end portion of pipe 82 extends out through the top end of the flue 38 and is provided with a coupling 84 which couples it with a conduit 86 forming part of the conduit loop 66. Conduit 86 connects with the horizontal leg of fitting 56.

The main water heater 10 operates in the usual manner to heat the water in tank 12. When heat is called for, gas is supplied to the main burner 20 and is ignited by the flame of the pilot burner 24 to heat the water in tank 12. When the water is heated sufficiently, the supply of gas to burner 20 is cut off and the main burner goes off.

The pilot burner 24 burns continuously, and its heat is captured by the heat exchanger 75 and used to heat the water that is circulating through the conduit loop 66. Pump 73 operates continuously to pump water from the storage tank 48 through pipe 60, fitting 62, conduit 68, pipe 72, the U-shaped pipe 74, pipe 82, conduit 86, fitting 56 and back into tank 48 through pipe 54. As the water passes through the U-shaped pipe 74, it is heated by the pilot burner 24, and it is noted that the hood 76 effectively traps the pilot light heat in chamber 80 and concentrates it on pipe 74 and the water flowing therein. The use of corrugated pipe enhances the heat transfer, as does the U-shaped configuration of pipe 74.

The circulating water in loop 66 is heated additionally in the corrugated pipe sections 72 and 82 which extend in the flue 38. The heat of the main burner 20 and its combustion gases is transferred to the water in pipe sections 72 and 82, and this heat is thus used for heating of the water rather than simply being lost out the flue. Agan, the corrugations of pipes 72 and 82 enhance the heat transfer.

The heat which is transferred to the water in conduit loop 66 results in preheating of the water which is stored n the storage tank 48. When water is drawn out of the main tank 12 through the hot water outlet pipe 46, t is replaced by preheated water which is transferred through the transfer conduit 64 from the storage tank to the main tank. Since all of the water which is supplied to the main tank 12 is thus preheated water, the heatng requirements of the main burner 20 are reduced in comparison to the conventional arrangement in which the water suppled to the hot water heater is cold water.

It has been found that the temperature in the flue 38 is normally in the range of about 100° F. -150° F. when only the pilot burner 24 is on. When the main burner 20 is on, the flue temperature s approximately 350° F. -400° F. By effectvely transferring heat from the combuston gases n the flue to the water which is stored in the storage tank 48, significant efficiences are acheved. In addtion, by concentratng the heat generated by the pilot burner 24 n the heat exchange chamber 80, the normally wasted pilot flame heat is effectively transferred to the crculating water to result in additional efficiencies in the usage of energy. The electrical energy needed to operate the pump 73 s mnimal. It is preferred that a 20 watt pump be used, and it can be operated continuously at an energy cost of approximately one dollar per month.

The spiral configuration of the corrugated pipe sections 72 and 82 permit these pipe sections to serve as baffles which increase the resdence time of the hot combustion gases in the flue 38. In addition, the spiral configuration results in a large surface area presented by the pipe sections in the flue, and this further enhances the heat transfer. Because heat exchanger 75 is able to concentrate the pilot flame heat and use it for the heating of water, it is not always necessary to extend the conduit loop through the water heater flue.

During times of low hot water use (such as during the night), the heat from the pilot burner is sufficient by itself to heat the fifty gallons of water in tank 48 to a temperature close to the desired hot water temperature of 130° F. -140° F. This hot water is available in the morning when the demand for hot water is normally rather high. When hot water is being rapidly used, the main burner 20 comes on to raise the flue temperature. Then, the water circulating through loop 66 is heated rapidly and the recovery rate is increased.

FIG. 4 illustrates a second embodiment of the invention in which the electric pump is eliminated and back flushing of the conduit loop is effected. In the FIG. 4 embodiment, the main tank 12 and the storage tank 48 are substantially identical to those described earlier, and other parts of the system that are the same as those described earlier are identified by the same reference numerals in FIG. 4 as were used in FIG. 1.

In the arrangement illustrated in FIG. 4, a conduit loop 166 has a short inlet pipe 160 which communicates with the bottom of storage tank 48. A tee fitting 161 connects with pipe 160 and with another pipe 168. The third leg of fittng 161 is equipped with a drain valve 169. A coupling 170 couples pipe 168 with a corrugated pipe 172 which extends through the access door of the main tank 12 and into the combustion chamber 18. Pipe 172 extends through a heat exchanger 175 and upwardly in a spiral pattern through flue 38. Above tank 12, the corrugated pipe 172 is connected by coupling 184 with a conduit 186 which leads to the horizontal leg of fitting 56. Conduit 186 is generally horizontal but slopes up somewhat from coupling 184 to fitting 56.

Referring now to FIG. 5 in particular, pipe 186 has a slightly upturned open end 186a dsposed within ftting 56 and the vertical pipe which is formed by pipes 54 and 58 and fttng 56. End 186*a* does not completely block the vertical pipe but does open into it for a purpose that will b made clear.

The heat exchanger 175 includes an arcuate hood 176 which is disposed immedately above the pilot burner 24 in order to trap and concentrate the heat generated by the pilot burner. Pipe 172 extends through a heating chamber 180 formed within the hood 176 such that the water circulatng through conduit loop 166 is heated by the pilot burner.

In the arrangement of FIG. 4, water is transferred from storage tank 48 to the main tank 12 through a single transfer conduit 164 having its nlet end located near the top of tank 48 and its outlet end located near the bottom of tank 12.

In operation of the system shown in FIG. 4, no water flows through pipe 58 when the water taps and applicancs are all off. Then, the water in conduit loop 166 is heated in the corrugated pipe 172 by the heat from the pilot burner 24 and also by the heat from the main burner 20 when it is fired. The pilot heat is concentrated in the heat exchanger 175, while the main burner hat is captured primarily in the flue 38. The water which is heated in pipe 172 naturally rises therein and flows through pipe 186 and into fitting 56 through end 186a. The water then flows downwardly into tank 48 through pipe 54. At the same time, the thermally induced upward flow of water in pipe 172 creates a suction force in pipes 168 and 160, and water from tank 48 is drawn into pipe 160 to replace the water which is discharged from pipe 54 into the storage tank. It is noted that the water entering pipe 160 is relatvely cool water from near the bottom of tank 48.

In this manner, thermally induced circulation of water through the conduit loop 166 occurs naturally due to the heating of the water therein by the pilot burner 24 and the main burner 20. Consequently, the water in the storage tank 48 is preheated by making effective use of heat that would otherwise be essentially wasted.

When a hot water tap or appliance is turned on, hot water from tank 12 is delivered to the tap or aplicance through pipe 46 and the branch pipes of the pipe network. Then, the hot water removed from tank 12 is replaced by preheated water from tank 48 which is transferred through conduit 164 to the main tank. The incoming cold water that flows through pipe 58 enters fitting 56 in a downward path, and part of the incomng water enters the open upturned end 186*a* of pipe 186. The remainder of the incoming water enters tank 48 through pipe 54. The water diverted into piipe 186 flows through conduit loop 166 in a direction opposite the direction of flow when the taps and appliances are off. The water in the conduit loop 166 flows downwardly at a relatively fast rate in pipe 172 through flue 38 and then through the heat exchanger 175 before entering tank 48 through pipes 168 and 160. The main burner 20 normally comes on at this time because of the depletion of the hot water, and the main burner 20 and pilot burner 24 heat the water that is circulating in a reverse direction in the conduit loop 166. This portion of the incoming water is preheated before reaching the storage tank 48. Once the taps and/or appliances are again turned off, the system reverts to its normal operation described earlier.

It is important to recognize that the rapid flow of water in the reverse direction through conduit loop 166 occurs automatically whenever a hot water tap or appliance is turned on. This reverse flow at a relatively fast flow rate back flushes conduit loop 166 and keeps the heat exchanger 175 and related parts of the system clean.

FIG. 6 depicts the storage tank 48 and related piping arranged according to still another embodiment of the invention. It is to be understood that the storage tank 48 shown in FIG. 6 connects with the main tank in substantially the same manner illustrated in FIG. 4. It is also to be understood that the same reference numerals are used in FIG. 6 to refer to components which are also included in the system of FIG. 4.

In the system of FIG. 6, pipe 286 has a conventional connection with the T fitting 56, rather than the special connection shown in FIG. 5 for pipe 186. Pipe 286 connects with corrugated pipe 172 in the same manner shown in FIG. 4 for pipe 186. A flexible tube or hose 290 is provided inside of tank 48 in the FIG. 6 arrangement. Hose 290 is smaller in diameter than pipes 54 and 160, and opposite ends of hose 290 are fitted in the open ends of pipes 54 and 160.

In operation, the system of FIG. 6 functions in the same manner as the FIG. 4 system when the hot water taps and appliances are off. Thermally induced circulation of water through the heat exchanger and flue occurs in conduit loop 166, and the water in the storage tank 48 is thereby preheated before being supplied to the main tank.

When one or more hot water taps or appliances are turned on, the incoming cold water in pipe 58 passes through fitting 56 and pipe 54. Because hose 290 is smaller than pipe 54, part of the incoming water enters tank 48 and the remainder of the incoming water enters hose 290 and flows through the hose into pipe 160. The flow of incoming water through hose 290 takes place at a relatively high speed, and the water which enters pipe 160 from the smaller hose 290 induces additional water from tank 48 to enter pipe 160, as shown by the directional arrows in FIG. 6. The result is that when incoming water is supplied to tank 48, water is circulated through the conduit loop 166 at a high speed, and this high speed flow flushes the heat exchanger and related parts whenever the hot water is turned on.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a hot water heating system having a main tank, a cold water inlet pipe connected with a supply of cold water to be heated, a fuel fired main burner for heating water in the main tank, a fuel fired pilot burner for igniting the main burner, and a flue in the main tank for discharging combustion gases, the improvement comprising:

a storage tank for holding water which is to be preheated prior to transfer to the main tank, said cold wate rinlet pipe discharging into said storage tank to deliver thereto incoming cold water to be heated;

a conduit loop having an inlet end communicating with said storage tank to receive water therefrom and an outlet end communicating with said storage tank to return preheated water thereto, said conduit loop having an intermediate portion thereof extending in said flue in a generally spiral configuration to extract heat from the flue for preheating of water circulating in the conduit loop; and a transfer conduit extending from said storage tank to said main tank to deliver preheated water from the storage tank to the main tank to replace hot water drawn out of the main tank.

2. The improvement of claim 1, wherein said intermediate portion of the conduit loop comprises a pair of pipe sections through which water is circulated in opposite directions.

3. The improvement of claim 2, including:

a heat exchanger located adjacent the pilot burner to be heated thereby; and a conduit section forming part of said conduit loop, said conduit section being located between said pipe sections and extending through said heat exchanger to effect heating of the water in said conduit section.

4. A method of enhancing energy efficiency in a hot water heater having a main tank, a fuel fired main burner for heating water in the main tank, a fuel fired pilot burner for igniting the main tank, and a flue in the main tank for discharging combustion gases, said method comprising the steps of:

delivering incoming cold water to a storage tank;

circulating water from the storage tank through a conduit in a preselected direction to pass the water in the conduit in heat exchange relationship with the pilot burner and through the flue to thereby use the pilot burner heat and the flue heat to heat the water in the conduit;

returning the heated water in the conduit to the storage tank; and transferring water from the storage tank to the main tank when the main tank calls for water, whereby the water supplied to the main tank for heating therein is preheated to reduce the heating requirements of the main burner.

5. The method of claim 4, including the step of effecting circulation of water through said conduit in a direction opposite said preselected direction at selected times to thereby back flush said conduit.

6. The method of claim 4, including the step of increasing the speed of the water circulated through said conduit at selected times, thereby flushing said conduit.

* * * * *

UNITED STATES PATENT AND TRADEMARK OFFICE

CERTIFICATE OF CORRECTION

PATENT NO. : 4,821,682

DATED : April 18, 1989

INVENTOR(S) : Larry G. Waters

It is certified that error appears in the above-identified patent and that said Letters Patent is hereby corrected as shown below:

Column 7, line 38, "wate rinlet" should read -- water inlet --.

Column 8, line 22, "tank" should read -- burner --.

Signed and Sealed this

Third Day of October, 1989

*Attest:*

DONALD J. QUIGG

*Attesting Officer*

*Commissioner of Patents and Trademarks*